US009643767B2

(12) United States Patent
Ziemba

(10) Patent No.: US 9,643,767 B2
(45) **Date of Patent: *May 9, 2017**

(54) COMPARTMENTALIZED PROTECTIVE CASE FOR PORTABLE HANDHELD ELECTRONIC DEVICES

(71) Applicant: John T. Ziemba, Edison, NJ (US)

(72) Inventor: John T. Ziemba, Edison, NJ (US)

( * ) Notice: Subject to any disclaimer, the term of this patent is extended or adjusted under 35 U.S.C. 154(b) by 212 days.

This patent is subject to a terminal disclaimer.

(21) Appl. No.: 13/987,418

(22) Filed: Jul. 23, 2013

(65) Prior Publication Data

US 2014/0034546 A1 Feb. 6, 2014

Related U.S. Application Data

(62) Division of application No. 12/589,210, filed on Oct. 20, 2009, now Pat. No. 8,499,933.

(51) Int. Cl.
*A45C 1/04* (2006.01)
*B65D 71/00* (2006.01)
(Continued)

(52) U.S. Cl.
CPC ..... *B65D 71/00* (2013.01); *A45C 11/00* (2013.01); *A45C 11/008* (2013.01); *A45D 33/26* (2013.01);
(Continued)

(58) Field of Classification Search
CPC ..... A45D 33/006; A45C 11/00; A45C 11/008; A45C 11/182; A45C 11/321; A45C 1/04
(Continued)

(56) References Cited

U.S. PATENT DOCUMENTS 1,498,475 A * 6/1924 Mosheim ..... A45D 33/006 132/287
3,441,033 A * 4/1969 Flax ..... A45D 33/20 132/295
(Continued)

FOREIGN PATENT DOCUMENTS

KR 2008/0036823 4/2008 ..... A45D 33/00
WO WO2008/024521 2/2008 ..... A45C 13/30

OTHER PUBLICATIONS

"Naztech The Voyage Cell Phone Case" by LTgear.com, found at http://www.ltgear.com/bags_cases.aspx?ID=3367.
(Continued)

*Primary Examiner* — King M Chu
(74) *Attorney, Agent, or Firm* — Ernest D. Buff & Associates, LLC; Ernest D. Buff, Esq.; Margaret A. LaCroix, Esq.

(57) ABSTRACT

A compartmentalized protective case houses a portable electronic device and personal care items that are organized and held securely therewithin. The compartmentalized protective case has a major compartment for receiving and housing an electronic device such as a smart phone, cellular phone, music player, or other digital media device. At least one cell compartment constructed within the case receives and houses personal care items removably integrated therein. Personal care items include a plurality of interchangeable replacement cells containing beauty items, cosmetics, hygienic items, oral care products such as floss or breath strips, medications, vitamins, breathe fresheners and/or health care products. A second cell compartment is preferably provided as a removable pouch or restraining system for holding identification cards, currency, visa or bank cards, and/or keys.

16 Claims, 14 Drawing Sheets

(51) Int. Cl.

| | |
|---|---|
| ***A45C 11/00*** | (2006.01) |
| ***A45D 33/26*** | (2006.01) |
| *A45C 11/24* | (2006.01) |
| *A45C 13/30* | (2006.01) |

(52) U.S. Cl.
CPC ..... *A45C 11/24* (2013.01); *A45C 2011/007* (2013.01); *A45C 2013/303* (2013.01)

(58) Field of Classification Search
USPC ..... 206/320, 576, 235; 132/294, 295, 297
See application file for complete search history.

(56) References Cited

U.S. PATENT DOCUMENTS

| | | | | |
|---|---|---|---|---|
| 4,421,127 | A * | 12/1983 | Geer | 132/294 |
| 4,589,430 | A * | 5/1986 | Sussman | 132/218 |
| 4,898,195 | A | 2/1990 | Sussman | 132/317 |
| 4,932,547 | A * | 6/1990 | Rodriguez | A45C 11/24 206/1.5 |
| 4,936,463 | A | 6/1990 | Tiramani | 206/581 |
| 5,005,697 | A * | 4/1991 | Jimbo et al. | 206/235 |
| 5,054,505 | A * | 10/1991 | Yuhara | A45D 40/22 132/294 |
| 5,163,457 | A * | 11/1992 | Lombardi, Jr. | A45D 42/02 132/294 |
| 5,348,347 | A | 9/1994 | Shink | 281/31 |
| 5,353,947 | A * | 10/1994 | Zinnbauer et al. | 220/812 |
| 5,379,884 | A | 1/1995 | Bigott | 206/37 |
| 5,560,476 | A | 10/1996 | Lee | 206/38 |
| 5,638,839 | A * | 6/1997 | Montoli | A45D 40/22 132/294 |
| 5,813,420 | A * | 9/1998 | Sussman | 132/294 |
| 5,890,052 | A | 3/1999 | Read et al. | 455/575.3 |
| 5,924,558 | A | 7/1999 | De Mayo | 206/5 |
| 6,223,900 | B1 * | 5/2001 | Pappas | 206/576 |
| 6,286,667 | B1 | 9/2001 | Lee | 206/38 |
| 6,311,077 | B1 * | 10/2001 | Bien | A45D 33/26 455/344 |
| 6,357,646 | B1 | 3/2002 | Gur et al. | 224/683 |
| 6,363,947 | B1 * | 4/2002 | Wu | 132/297 |
| 6,422,245 | B1 * | 7/2002 | Song | 132/295 |
| 6,424,823 | B1 | 7/2002 | Moles | 455/90.1 |
| 6,501,643 | B1 * | 12/2002 | Sayers et al. | 361/679.56 |
| 6,651,854 | B1 | 11/2003 | La Coste | 224/196 |
| 6,788,919 | B2 * | 9/2004 | Watanabe | 455/90.3 |
| 7,047,983 | B2 * | 5/2006 | Manougian | A45D 40/22 132/294 |
| 7,077,596 | B1 | 7/2006 | Bianco et al. | 402/73 |
| 7,086,437 | B1 | 8/2006 | Michael | 150/103 |
| 7,099,710 | B1 | 8/2006 | Faillance | 455/575.8 |
| 7,140,372 | B2 * | 11/2006 | Byun | 132/287 |
| 7,140,872 | B2 | 11/2006 | Nishimura et al. | 425/589 |
| 7,146,184 | B1 * | 12/2006 | Tsitsiashvili | 455/550.1 |
| 7,194,289 | B1 | 3/2007 | Flores, Jr. | 455/575.1 |
| 7,204,398 | B1 | 4/2007 | Smith, Sr. | 224/607 |
| 7,237,677 | B2 * | 7/2007 | Berg | 206/581 |
| 7,254,424 | B1 | 8/2007 | Reichert | 455/575.1 |
| 7,343,184 | B2 | 3/2008 | Rostami | 455/575.8 |
| 7,353,938 | B2 | 4/2008 | Moldolan | 206/232 |
| 7,387,209 | B2 | 6/2008 | Ko et al. | 206/579 |
| 7,431,161 | B2 * | 10/2008 | Carlino | 206/581 |
| 7,447,531 | B2 | 11/2008 | Eswaraiah | 455/575.8 |
| 7,757,919 | B2 | 7/2010 | Hassett | 224/675 |
| 2003/0000864 | A1 * | 1/2003 | Carraro | 206/576 |
| 2004/0173482 | A1 * | 9/2004 | Nieves | 206/320 |
| 2006/0042971 | A1 | 3/2006 | Holmes et al. | 206/235 |
| 2006/0105821 | A1 | 5/2006 | Goradesky et al. | 445/575.1 |
| 2006/0112966 | A1 | 6/2006 | Phue | 132/296 |
| 2006/0121962 | A1 | 6/2006 | Kohli | 455/575.8 |
| 2007/0051645 | A1 | 3/2007 | Hassett | 206/316.2 |
| 2007/0113306 | A1 | 5/2007 | Paci et al. | 455/575.1 |
| 2007/0259704 | A1 | 11/2007 | Jung | 455/575.8 |
| 2008/0032758 | A1 | 2/2008 | Rostami | 455/575.8 |
| 2008/0135144 | A1 | 6/2008 | Brody | 150/113 |
| 2008/0149235 | A1 | 6/2008 | Jay | 150/143 |
| 2008/0257376 | A1 | 10/2008 | Pires et al. | 132/287 |
| 2008/0314941 | A1 | 12/2008 | Knych | 224/191 |
| 2009/0036174 | A1 | 2/2009 | Brandenburg et al. | 455/575.1 |
| 2009/0045091 | A1 | 2/2009 | O'Neill et al. | 206/449 |
| 2009/0166247 | A1 | 7/2009 | Gindi | 206/581 |
| 2010/0012536 | A1 | 1/2010 | Winsche | 206/316.2 |
| 2010/0093412 | A1 | 4/2010 | Serra | 455/575.8 |
| 2010/0144411 | A1 | 6/2010 | Pettingill | 455/575.8 |
| 2011/0089077 | A1 | 4/2011 | Ziemba | 206/570 |
| 2011/0089078 | A1 | 4/2011 | Ziemba | 206/570 |

OTHER PUBLICATIONS

"V6075 All-N-One Cell Phone Case and Wallet" by Vitronicpromotional.com, found at http://www.victronicpromotional.com/productdetail.aspx?id=V6075.

"Cell Phone Wallet" by Celi.com, found at http://www.celicase.com/cell_phone_wallet.cfm.

"Sena Cases Iphone 3G and Iphone 3G S WalletBook Case—Red" by HandHeldItems.com, found at http://www.handhelditems.com/sena-cases-Iphone-walletbook-case-p-18159.html.

"Sena Cases iPhone 3G S WalletBook Case—Red" by HandHeldItems.com found at http://www.amazon.com/Sena-Wa1letBook-Case-iPhone-3GS/dp/B002VBXKXK html.

"V065 All_N-One Cell Phone Case and Wallet" found at http://www.liftpromos.com/prod/custom_all_n_one_cell_phone_case_22638.html.

* cited by examiner

COMPARTMENTALIZED PROTECTIVE CASE FOR PORTABLE HANDHELD ELECTRONIC DEVICES

BACKGROUND OF THE INVENTION

1. Field of the Invention

The present invention relates to a compartmentalized protective case for portable handheld electronic devices; and, more particularly to a compartmentalized protective case including a primary compartment appointed for receiving a portable handheld electronic device and at least one cell compartment appointed for receiving at least one personal item such as one or more interchangeable replaceable cells, which may include beauty items, cosmetics, hygiene items, medications, vitamins, breathe fresheners and/or health care products. Preferably, the compartmentalized protective case also has a second cell compartment constructed as a removable pouch for holding identification cards, currency, visa or bank cards, and/or keys.

2. Description of the Prior Art

Use of handheld electronic devices such as cell phones, smart phones, and media players has become extremely popular. Carrying handheld electronic devices, wallets, makeup, ID, health care products and other personal items on the person can become cumbersome. With the advent of consumers leaning toward sleeker, smaller and more compact handheld electronic devices such as cell phones, smart phones, and media players there is a need in the art for a sleek protective case that not only houses the device, but houses personal items, so that consumers do not need to carry excessive accessories on their person. Carrying cases for these devices are currently provided as holster type devices and/or pouches which receive and house the electronic device. However, none of the heretofore disclosed and utilized devices provide a protective case having compartments for housing personal items for compact convenience.

Travel compacts for carrying and housing makeup products have been provided for, however these compacts are not constructed with a compartment for a handheld electronic device. For example: U.S. Pat. No. 5,163,457 to Lombardi discloses a travel compact for housing a cosmetic supply and a mirror, both of which are encased by the compact in a storage mode. The supply and the mirror are both exposed in a utility mode whereby the user may then view her face as she applies the cosmetic thereto. U.S. Pat. No. 5,353,947 to Zinnbauer et al. discloses a cosmetic case having a base and a cover releasably secured to one another; and Foreign Publication No. KR20080036823 to Bae et al. discloses a cosmetic case. These compacts and cases are constructed and function to merely provide a case for housing and carrying cosmetics, and do not provide a compact protective case for carrying a handheld electronic device.

Conversely, other devices only provide a holder for electronic devices. These other devices fail to provide a protective case and fail to provide a compartment housing beauty, health products or personal items in a compact integrated manner. For example: U.S. Pat. No. 6,357,646 to Gur et al. discloses a holder for an article or mobile device that allows a device to be securely held in the holder while providing easy and flexible access to the personal device; U.S. Pat. No. 7,077,596 to Bianco et al. discloses a two-way pocket assembly for use with a notebook constructed over a window formed in a subsurface material of the notebook; U.S. Pat. No. 7,204,398 to Smith, Sr. discloses a multi-purpose wallet/cellular telephone case. This wallet/cellular telephone case includes a multi-sectional wallet unit having a central section and first, second, and third foldout sections that are integral with the central section; U.S. App. Pub. No. 2008/0149235 to Jay discloses a wallet having at least two surfaces defining an internal compartment; "Naztech The Voyage Cell Phone Case" by LTgear.com, found at http://www.ltgear.com/bags_cases.aspx?ID=3367 discloses a cell phone case that includes an area for storage of the cell phone and a separate bi-fold zip area for other personal items, such as keys, and the like; "V6075 All-N-One Cell Phone Case and Wallet" by Vitronicpromotional.com found http://www.vitronicpromotional.com/productdetail.aspx?id=V6075 discloses a cell phone case wallet; "Cell Phone Wallet" by Celi.com found at http://www.celicase.com/cell_phone_wallet.cfm discloses a cell phone wallet; "Sena Cases iPhone 3G and iPhone 3G S WalletBook Case—Red" by HandHeldItems.com found at http://www.handheldite-ms.com/sena-cases-iphone-walletbook-case-p-18159.html discloses a smartphone wallet-book case. These wallet type/or bi-fold cases do not provide at least one cell having personal care items integrated therein for receiving cosmetics and/or beauty or personal care products, or health products, instead these constructs are merely bi-folds or wallet type structures.

Still other devices have been provided concerning cellular phones with personal items actually integrated within the body of the cellular phone itself. Unfortunately, integration within the phone renders the items un-removable form the phone, while rendering the items useless if they become exhausted or if the user wishes to change or upgrade the phone. Integration within the phone itself vastly limits the ability for a user to select his/her own personal products, while also limiting the ability for cellular phone selection. For example: U.S. Pat. No. 6,424,823 to Moles discloses a cellular telephone comprising: 1) a handset case; 2) a display associated with the handset case capable of displaying alphanumeric characters when the cellular telephone is operated; and 3) a personal mirror associated with the cellular telephone. The cellular phone is taught to include a built-in personal mirror, but is not directed toward protective covers for cellular devices; U.S. Pat. No. 6,788,919 to Watanabe which discloses a cellular phone including a cosmetics container integrated therein, attached in a back of the cellular phone body; U.S. Pat. No. 7,146,184 to Tsitsiashvili discloses a personal communication and cosmetic storage device comprising a housing including personal communication circuitry having a first input portion and a second output portion pivotally connected to one another. At least one cosmetic storage layer is positioned within the first input layer for retaining and storing at least one type of cosmetic therein. The device is selectively operable in a first mode as a personal communication device and, in a second mode upon accessing the at least one cosmetic storage layer, thereby allowing a user to access the stored cosmetic for application thereof. These cellular phones have integral cosmetic packs encompassed therein and do not teach a protective case for receiving a cellular telephone, or other handheld portable device, wherein the case includes a compartment for receiving a handheld electronic device and a second compartment appointed for receiving and housing at least one personal item.

Separate carries have been provided wherein a cosmetic carrier is appointed to be attached to a separate cell phone case. For example, U.S. Pat. No. 7,431,161 to Carlino discloses a cosmetic carrier attachment for an electronic communications device that includes housing for retaining cosmetics and various configurations and elements for removably attaching the housing to the electronic communications device. The cosmetic carrier attachment includes a cosmetic case and means for attaching the cosmetic case to an electronic communications device. Appreciably, devices such as this provide a cosmetic carrier attachment including a cosmetic case and means for attaching the cosmetic case to an electronic communications device. The cosmetic carrier attachment is not a protective case for the electronic device, but instead is a cosmetic carrier that can be attached to the back of the electronic device. If the attachment becomes compromised, the device itself or the cosmetic carrier attachment could easily become lost.

Various purse-like devices have been provided that have the ability to hold a cellular phone and can receive items therein. However, these constructs are cumbersome in nature, and are not provided as a compact case. For example: U.S. Patent App. Pub. No. 2006/0112966 to Phue discloses a makeup case or kit comprising two hingedly connected compartments. A flat dividing element inserted between the compartments is hingedly held in place. A plurality of magnetic holders of the cosmetics supplies are removably insertable inside the first compartment; U.S. Patent App. Pub. No. 2008/0135144 to Brody discloses an adjustable size purse insert for easily transferring items from one purse to another. These devices are not protective, compact cases for a handheld electronic device, but are, instead, more like clutches or purses that are not small or compact in nature.

Even where cases have been provided which are appointed for housing personal electronic devices and personal items, these devices fail to provide integration of a plethora of personal items within a compartment in the case in a compact, organized, and replaceable manner. For example, U.S. App. Pub. No. 2009/0166247 to Gindi discloses a personal electronics device including a case having a first comp intent and a second compartment. A series of integrated electronic components perform a desired personal electronic function wherein at least a portion of the components are housed in the first compartment. The second compartment defines a selectively accessible storage volume. A cosmetic tray is housed in the accessible storage volume, and contains at least one form of cosmetic selected from the group of nail polish, mascara, eyeliner, lipstick, lip liner, and lip gloss. The cosmetic insert is slid out and removed when in use. It is not interstitially mounted in the case itself, but is received within a pocket/volume within the case. This is disadvantageous for at least two reasons. It would render the case less compact in nature, and heightens chances that the cosmetic insert would fall out and/or become lost. Although the cosmetic tray is replaceable, there is no indication that the actual deposits are individually replaceable cells.

Notwithstanding the efforts of prior art workers to construct a compartmentalized protective case for portable handheld electronic devices, there is a need in the art for a compact compartmentalized protective case for a personal electronic device that also compactly includes personal care products integrated therein. In addition, there remains a need in the art for a compartmentalized protective case that includes a primary compartment appointed for receiving a portable handheld electronic device and at least one cell compartment appointed for receiving at least one personal item that is preferably directed to a plurality of interchangeable replaceable cells including beauty items, cosmetics, hygiene items, medications, vitamins, breathe fresheners and/or health care products. There further exists a need in the art for a compartmentalized protective case wherein personal care items are provided in a plurality of replacement cells secured within a cell compartment within a case.

SUMMARY OF THE INVENTION

The present invention provides a compartmentalized protective case for housing a portable electronic device and personal care items that are organized and securely held within the case. The compartmentalized protective case has a major compartment appointed to receive and house an electronic device such as a smart phone, cellular phone, music player, or other digital media device. At least one cell compartment is constructed within the case with means for receiving and housing personal care items removably integrated therein. Preferably the personal care items are provided as a plurality of interchangeable replacement cells including beauty items, cosmetics, hygienic items, oral care products such as floss or breath strips, medications, vitamins, breathe fresheners and/or health care products. Preferably, a second cell compartment is provided that is constructed as a removable pouch or restraining system, for holding identification cards, currency, visa or bank cards, and/or keys.

Carrying electronic devices, wallets, makeup, ID and other personal items on the person can become cumbersome. With the advent of consumers leaning toward sleeking, smaller and more compact handheld electronic devices such as cell phones, smart phones, and media players there is a need in the art for a sleek protective case that not only houses the device, but houses personal items. In this manner, consumers do not need to carry excessive accessories on their person. None of the heretofore disclosed and utilized cases for these devices provide compartments for housing personal items for compact convenience. Further none of the heretofore known devices include a compartment for housing makeup products.

Uniquely, the compartmentalized protective case herein provides a compact compartmentalized protective case appointed to house an electronic device as well as personal items. Personal items attended for storage in the compartmentalized protective case may include identification, keys, money, business cards, makeup (such as eye makeup, lip gloss, powder, foundation, and applicators thereof) beauty products in general, oral health care products, health products, medication, vitamins, hand sanitizer, lotions, anti-wrinkle creams and serums, a note pad, and/or other personal items.

Generally stated, the compartmentalized protective case is preferably constructed from a polymeric material forming a rigid protective case body. In one embodiment the case is constructed having a major compartment appointed for receiving and housing an electronic device and a cell compartment appointed for receiving and housing personal care items removably integrated therein. Electronic devices appointed to be received in the case include cell phones, smart phones, media players and music player devices. Preferably the personal care items are presented as a plurality of replacement/replaceable cells that carry personal items therein. The major/primary and/cell compartment may include a cover which hingedly operates to open and close to allow access to the compartment. Alternatively, the primary and/cell compartment are enclosed with sliding covers. What is more, a mirror or reflective material may be included within the cell compartment or on the cell compartment or major compartment covers so that a user to view herself/himself. An opening appointed to receive a wristlet attachment, or at least two parallel openings may be integrated within the case appointed to receive a strap or chain attachment so that the case resembles a small clutch.

Preferably, the cell compartment includes internal attachment means and the personal care items are integrated within replaceable cells including cell attachment means in mating communication for interchangeability and securing the replaceable cells within the cell compartment. These personal items may comprise a mini-makeup kit including internal attachment means for securing a plurality of makeup cells (replacement cells) having mating cell attachment means. The mini-makeup kit preferably includes internal attachment means and the makeup cells include cell attachment means in mating communication for securing the plurality of makeup cells, wherein the makeup cells are replaceable cells removable from the mini-makeup kit for unique selection and interchangeability of the makeup cells. The internal attachment means preferably comprises grooves/rails and the mating cell attachment means comprise rails/grooves so that the makeup cells are slidably secured within the mini-makeup kit. The internal attachment means may instead comprise low bond adhesive, mating clip, magnetic portions, or hook and loop fasteners mechanisms such as those sold under the trade name VELCRO. The makeup cells may include a plethora of beauty supplies, for example, the makeup cells may include items selected from a group consisting of foundation, concealed, lipstick, lip gloss, eye shadow, eye liner, mascara and blush and/or combinations thereof. What is more, at least one applicator may be provided for applying the makeup products.

Alternatively, the personal care items may comprise a mini-health care product kit. The mini-health care product kit in turn may include oral hygienic items comprising dental floss. For example a replaceable floss wheel with a typical cutting portion may be provided, such as those currently sold, but in a smaller configuration so as to fit within the compact case. Conversely, instead of a floss wheel, floss pieces may simply be provided as precut floss pieces having a length ranging between two to four inches. Optionally, the mini-health care product kit may be made-up of hygienic items consisting of lotions, serums, sun screens and anti-aging creams. In this manner the cells are provided as shallow trays wherein the lotion or serums are injected into the trays and allowed to set for packaging. Other personal care items may be provided including a mini-health care product kit comprising items such as breath strips, breath mints, gum, and candies. Still alternatively, the optional mini-health care product kit may include cells for pill medication, cold medication, vitamins, eye drops, ointment, adhesive strips for cuts, bandages and hand sanitizers.

A second cell compartment may be provided that is either integrated within the case or provided as a removable pouch removably attached to the case. The pouch may be attached by way of hook and loop fasteners, such as those sold under the trade name VELCRO, or by way of magnetic attachment to the case. Instead of a pouch, the optional third cell compartment may be constructed as a restraining system, preferably a netted restraining system, wherein the netting is integrated within the case and provides shallow depth containment for holding identification cards, currency, keys, or other shallow depth items.

A method of using a compartmentalized protective case for a portable electronic device is provided. The method comprises the steps of: (a) inserting the portable electronic device into a major compartment of the compartmentalized protective case; (b) selecting personal care items comprising a plurality of replaceable cells; (c) inserting the selected replaceable cells within a cell compartment of the compartmentalized protective case, the cell compartment having internal attachment means and the replaceable cells including cell attachment means in mating communication for interchangeability and securing the replaceable cells within the cell compartment; and (d) replacing and interchanging the selected replaceable cells as desired or as the selected replaceable cells become used-up or depleted.

BRIEF DESCRIPTION OF THE DRAWING

The invention will be more fully understood and further advantages will become apparent when reference is had to the following detailed description of the preferred embodiments of the invention and the accompanying drawings, in which.

DETAILED DESCRIPTION OF THE INVENTION

The present invention is directed to a compartmentalized protective case for housing a portable electronic device and personal care items that are organized and held securely within the case. The compartmentalized protective case is constructed having a major compartment appointed for receiving and housing a handheld electronic device such as a smart phone, cellular phone, music player, or other digital media device. At least one cell compartment is constructed within the case that is appointed for receiving and housing personal care items removably integrated therein. Preferably the personal care items are provided as a plurality of interchangeable replacement cells including beauty items, cosmetics, hygienic items, oral care products such as floss or breath strips, medications, vitamins, breathe fresheners and/or health care products. A second cell compartment may be provided that is constructed as a removable pouch or restraining system for holding identification cards, currency, visa or bank cards, and/or keys.

The compartmentalized protective case is appointed to house an electronic device such as cell phones and/or smart phones such as those sold under the trade names iPhone® and Blackberry®, media players such as those sold under the trade name iPod®, and any other electronic devices. The protective case is preferably constructed of a durable material forming a shell so as to provide protection to the electronic device housed therein, including a polymeric, lightweight metal, rubber, silicone material and/or combinations thereof. Alternatively, the protective case may be constructed using less rigid materials, such as canvas, fibers and/or combinations thereof.

Figure 1:
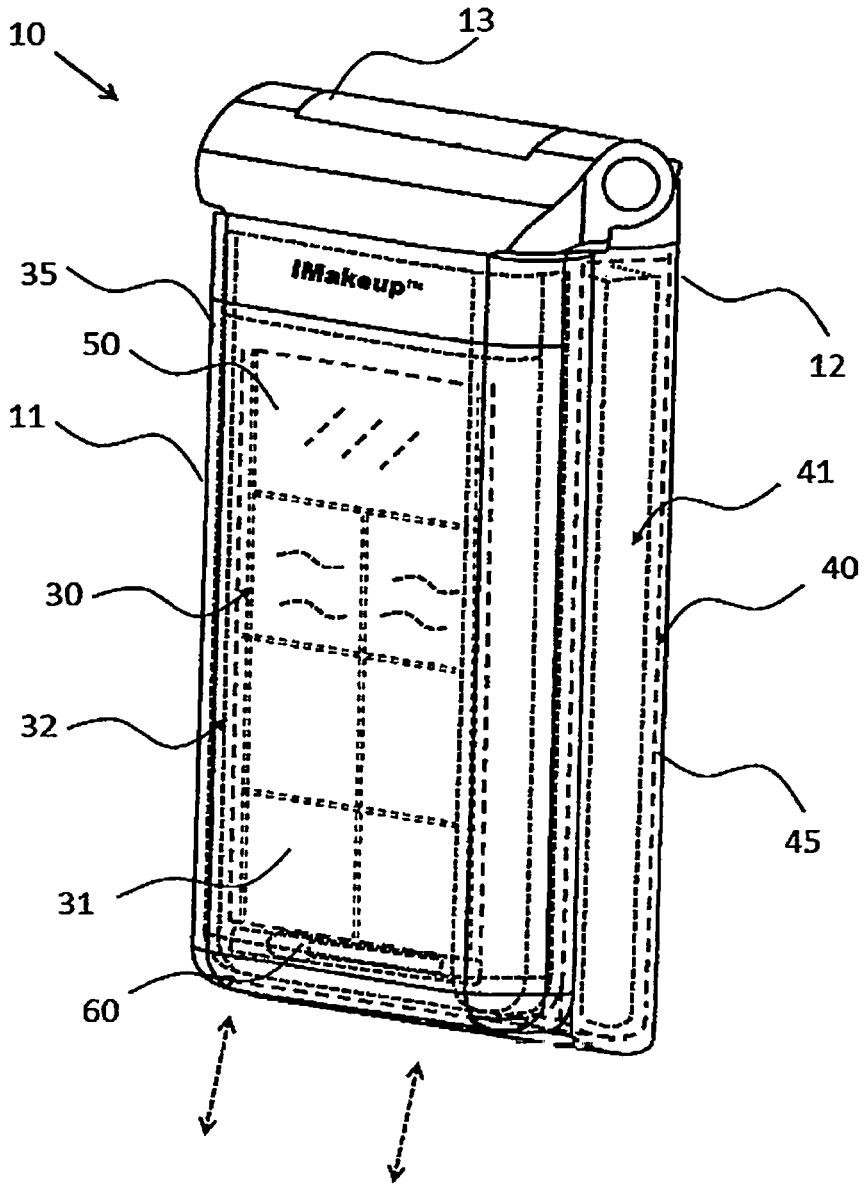
FIG. 1 illustrates a first embodiment of the compartmentalized protective case shown in the assembled, closed view.
Figure 2:
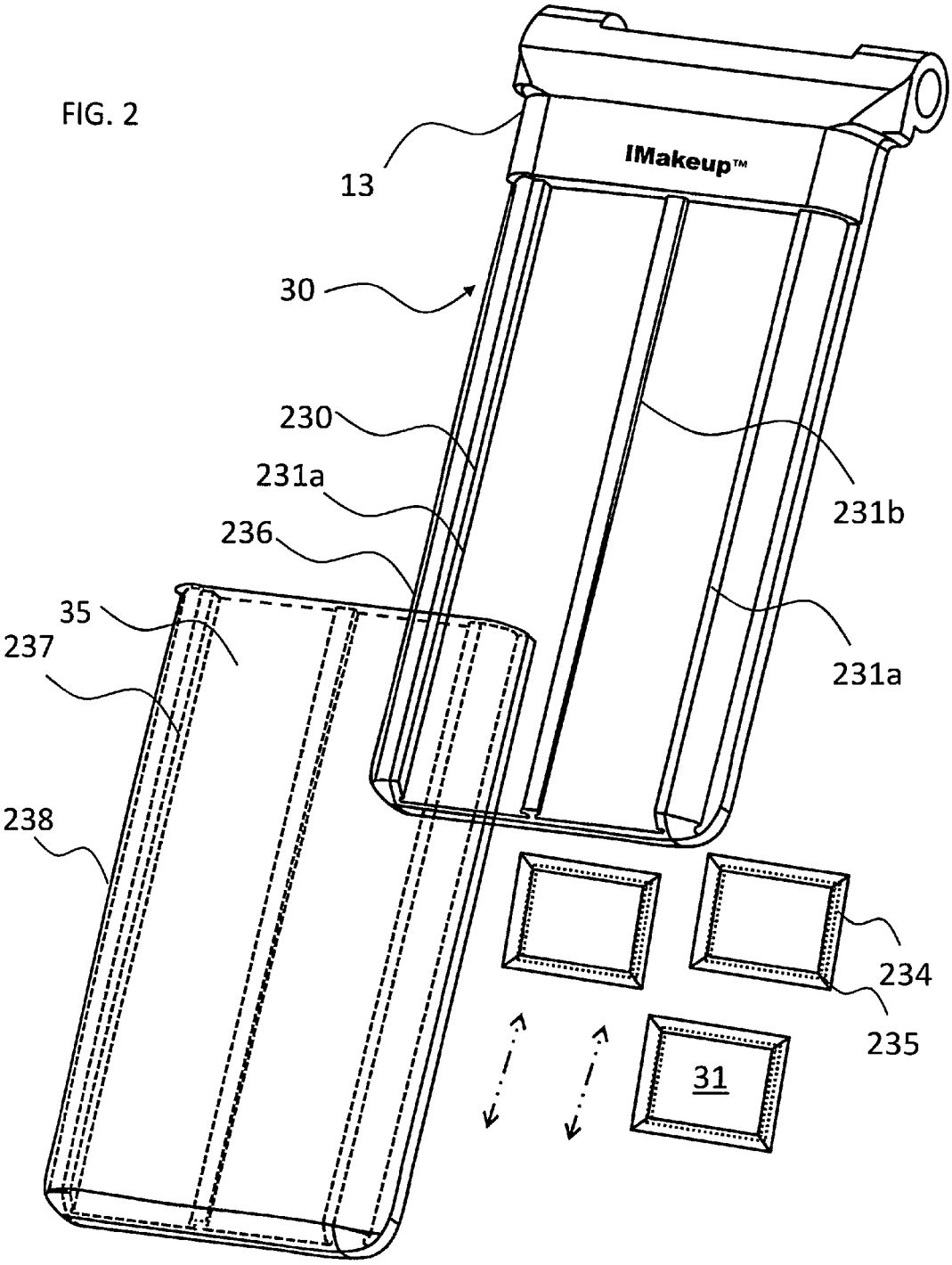
FIG. 2 illustrates the embodiment of the cell compartment and closure lid with replaceable cells of FIG. 1 in a disassembled view.
Figure 3A:
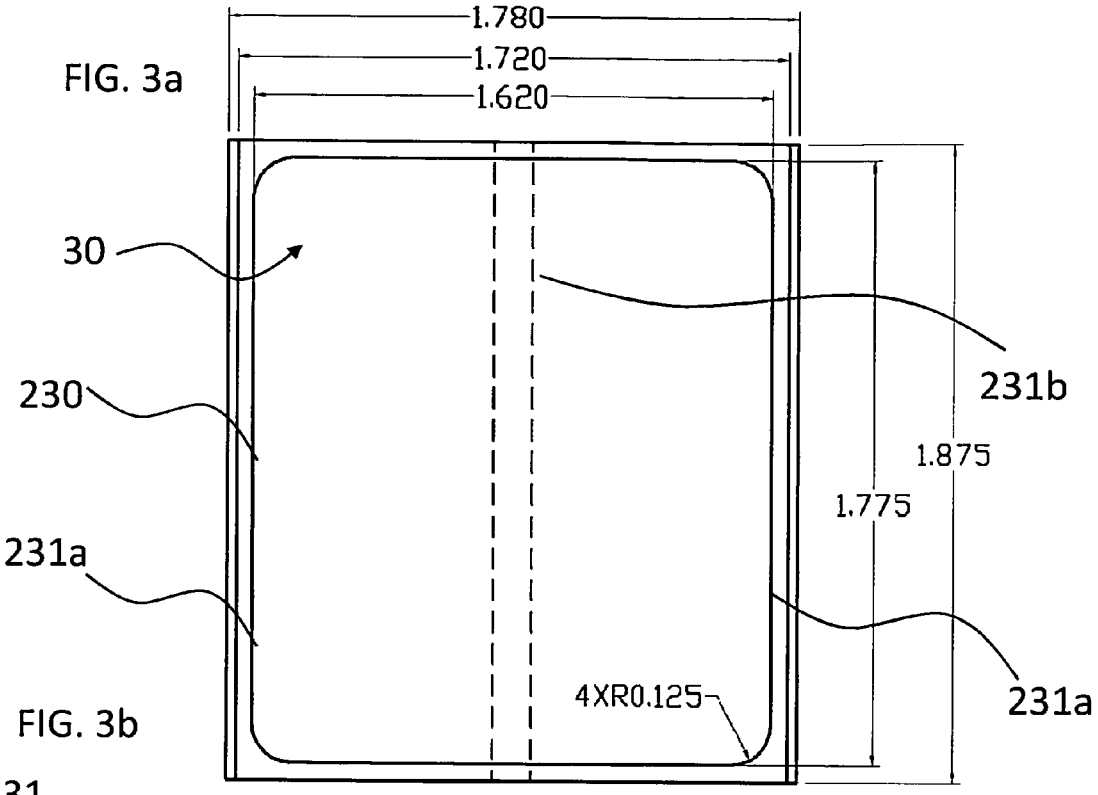
FIG. 3*a* illustrates a schematic view of the cell compartment of FIG. 2.
Figure 3B:
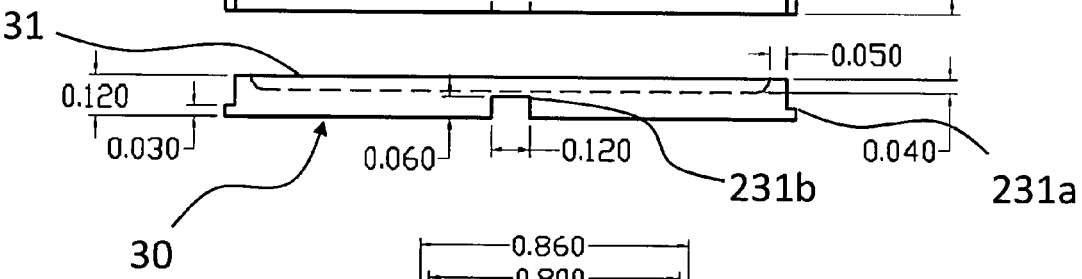
FIG. 3*b* illustrates a cross-sectional side view of the cell compartment of FIG. 3*a;*
Figure 3C:
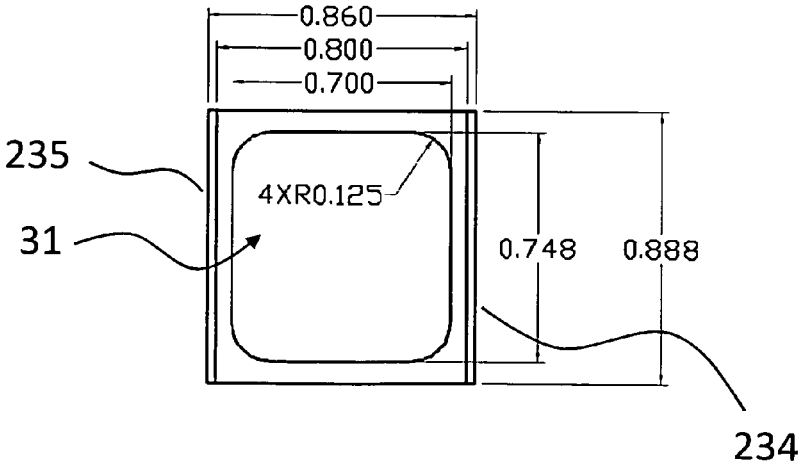
FIG. 3*c* illustrates a top view of a replacement cell.
Figure 3D:
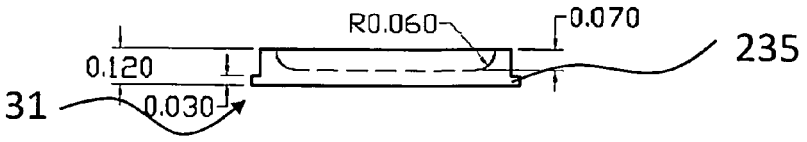
FIG. 3*d* illustrates a cross-sectional side view of the replacement cell.

FIG. 1 illustrates a first embodiment of the compartmentalized protective case shown in the assembled, closed view, shown generally at 10. Compartmentalized protective case 10 is constructed having a front side 11, back side 12, top 13, major compartment 40 and at least one cell compartment 30. Major compartment 40 is appointed for receiving and housing an electronic device 41, including hand held electronic devices such as cell phones and/or smart phones, including those sold under the trade names Iphone® and Blackberry®, media players such as those sold under the trade name iPod®, personal video game devices and any other handheld electronic devices. At least one cell compartment 30 is provided that is appointed for receiving and housing personal care items removably integrated therein. The cell compartment 30 is preferably provided with shallow side walls so that the compartment 30 is compact in nature. Preferably the personal care items are presented as a plurality of replacement/replaceable cells 31 that carry personal items therein. The major/primary 40 and/cell compartment 30 each include a cover 45, 35 which hingedly operates to open and close to allow access to the respective compartment 40, 30. The major compartment 40 and the cell compartment 30 are connected by way of a hinge 13' herein shown, without limitation, at top 13 that operates to provide open and close configurations for allowing access/closure to the major compartment 40 and cell compartment 30. Alternatively, the primary 40 and/cell compartment 30 are enclosed with sliding covers 45, 35, or combinations thereof. In the embodiment shown, cover 35 is a sliding cover as illustrated in FIG. 2. A mirror 50 or reflective material may be included within the cell compartment or on the cell compartment 30 as shown, or it may be located in the major compartment 40 so that a user to view herself/himself.

Major compartment/first compartment 40 is configured for receiving and housing the electronic device. First compartment/major compartment 40 has two major sides 42 and 43 including an open major first side 42*a* allowing the electronic device to be viewed from an exterior of the protective case when housed within the first compartment and a generally closed major second side 43*a* of the protective case opposing the open major first side 42*a* of the protective case. The open major first side 42*a* of the protective case is defined at least in part by first and second opposing sidewalls 45*a* and 45*b*. Each of the first and second sidewalls 45*a*, 45*b* defines at least a portion 46*a*, 46*b* configured to overlie the electronic device when housed within the first compartment/major compartment 40 so as to prevent the device from falling out of the open major first side 42*a*. A major side is defined as a side of the protective case having a larger surface area than a rest of the sides defined by the protective case.

The cell compartment 30 preferably includes internal attachment means and the personal care items are integrated within replaceable cells 31 including cell attachment means in mating communication for interchangeability and securing the replaceable cells within the cell compartment 30. Personal items may comprise a mini-makeup kit 32 including internal attachment means for securing a plurality of makeup cells (replacement cells) having mating cell attachment means as shown. The mini-makeup kit 32 preferably includes internal attachment means and the makeup cells 31 include cell attachment means in mating communication for securing the plurality of makeup cells 31. The makeup cells 31 may include a plethora of beauty supplies and may be readily mixed and matched depending on the user's needs, for example, the makeup cells may include items selected from a group consisting of foundation, concealed, lipstick, lip gloss, eye shadow, eye liner, mascara and blush and/or combinations thereof. At least one applicator 60 may be provided for applying the makeup products.

Alternatively, the personal care items may comprise a mini-health care product kit. The mini-health care product kit in turn may include oral hygienic items comprising dental floss. For example a replaceable floss wheel with a typical cutting portion may be provided, such as those currently sold, but in smaller configuration so as to fit within the compact case. Conversely, instead of a floss wheel, floss pieces may simply be provided as precut floss pieces having a length ranging between two to four inches. Optionally, the mini-health care product kit may be made-up of hygienic items consisting of lotions, serums, sun screens and anti-aging creams. In this manner the cells are provided as shallow trays wherein the lotion or serums are injected into the trays and allowed to set for packaging. Other personal care items may be provided including a mini-health care product kit comprising items such as breath strips, breath mints, gum, and candies. Still alternatively, the optional mini-health care product kit may include cells for pill medication, cold medication, vitamins, eye drops, ointment, adhesive strips for cuts, bandages and hand sanitizer.

FIGS. 2 and 3*a*-3*d* illustrate the embodiment of the cell compartment and closure lid with replaceable cells of FIG. 1 in a disassembled view. Referring to FIGS. 2 and 3*a*-3*d*, cell compartment 30 is shown disassembled. Cell compartment 30 is appointed for receiving and housing personal care items removably integrated therein, preferably constructed as a plurality of replacement/replaceable cells 31 that carry personal items therein. Cell compartment 30 includes a cover 35 which, in this embodiment, is slideabley mounted on cell compartment 30. Cell compartment 30 includes internal attachment means herein shown as tracks/rails including side rails 231*a* and a center rail 231*b* that mate with replacement cells 31 by way of communication with mating cell attachment means 234 provided as corresponding grooves 235 adapted to receive rails 231*a*, 231*b*. In this manner, replacement cells 31 are slid onto and mounted within cell compartment 30 so that the cells 31 do not fall from the device when cover 35 is slid open. This also prevents the cells 31 from shifting around within compartment 30. Alternatively, the internal attachment means may instead comprise low bond adhesive, mating clip, magnetic portions, or hook and loop fasteners mechanisms such as those sold under the trade name VELCRO. For sliding of cover 35, cell compartment 30 further includes outer rails 236 appointed to mate with corresponding grooves 237 located on walls 238 of cover 35.

Figure 4A:
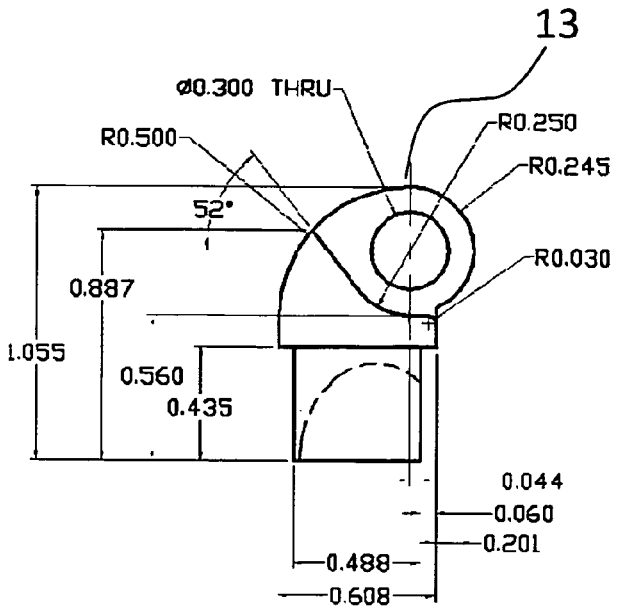
FIG. 4*a* illustrates a side-sectional view of the top portion of the case shown in FIG. 1.
Figure 4B:
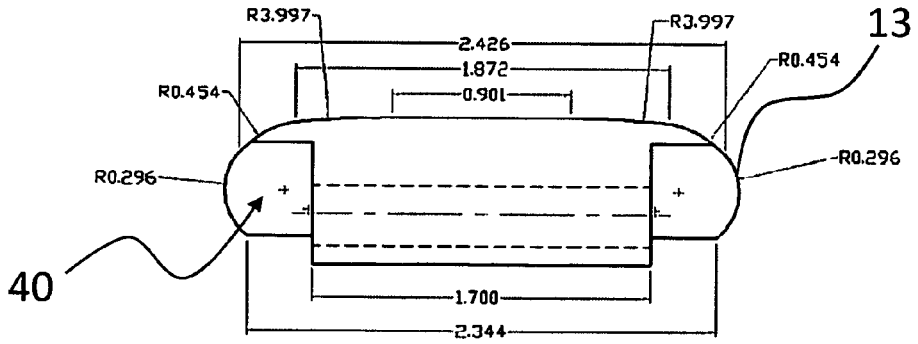
FIG. 4*b* illustrates a top-sectional view of the top portion of the case shown in FIG. 1.
Figure 4C:
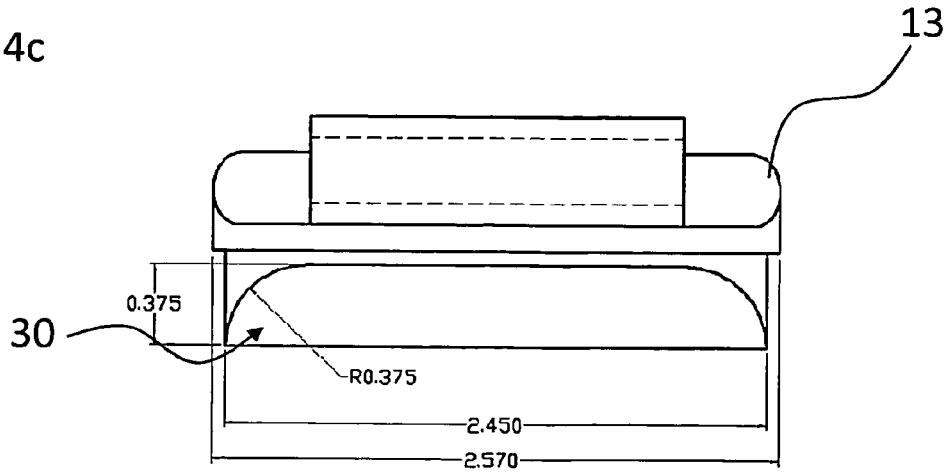
FIG. 4*c* illustrates a top-sectional view of the top portion of the case shown in FIG. 1.
Figure 5A:
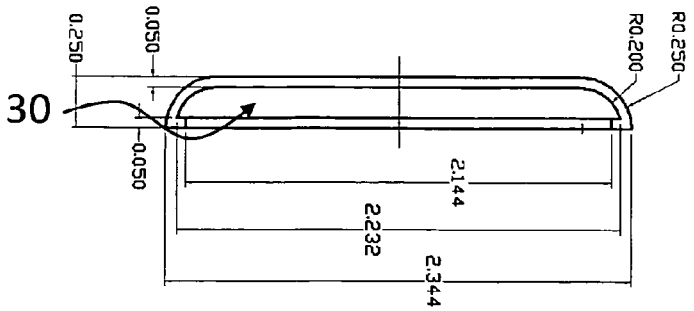
FIG. 5*a* illustrates a sectional view of the top of the cell compartment of the case shown in FIG. 1.
Figure 5B:
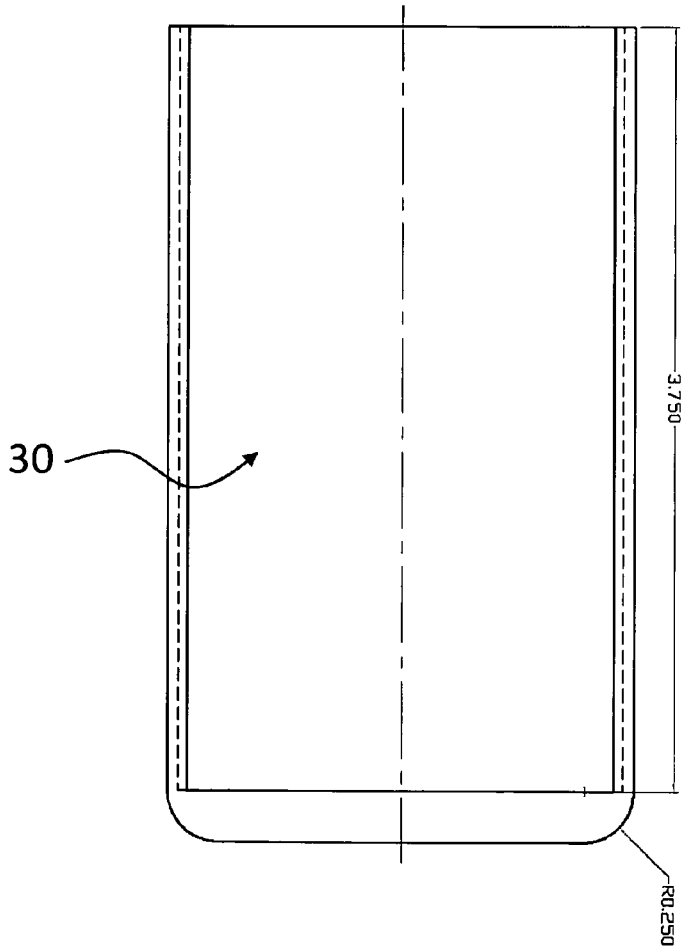
FIG. 5*b* illustrates a top planer view of the top portion of the cell compartment of the case shown in FIG. 1.
Figure 5C:
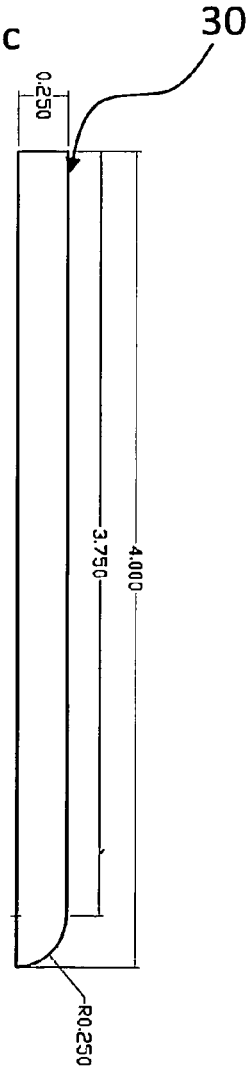
FIG. 5*c* illustrates a side view of the cell compartment of the case shown in FIG. 1.
Figure 6A:
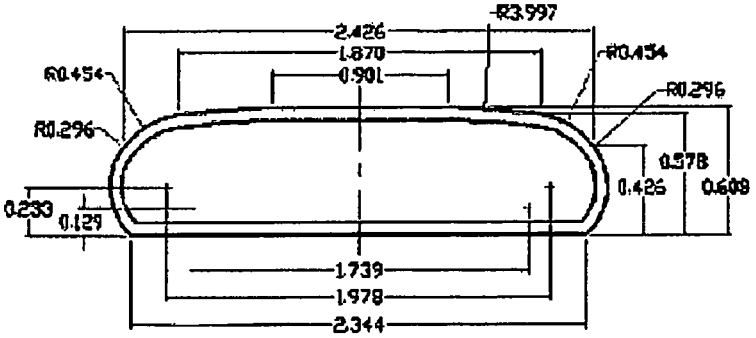
FIG. 6*a* illustrates a sectional view of the top of the major/primary compartment of the case shown in FIG. 1.
Figure 6B:
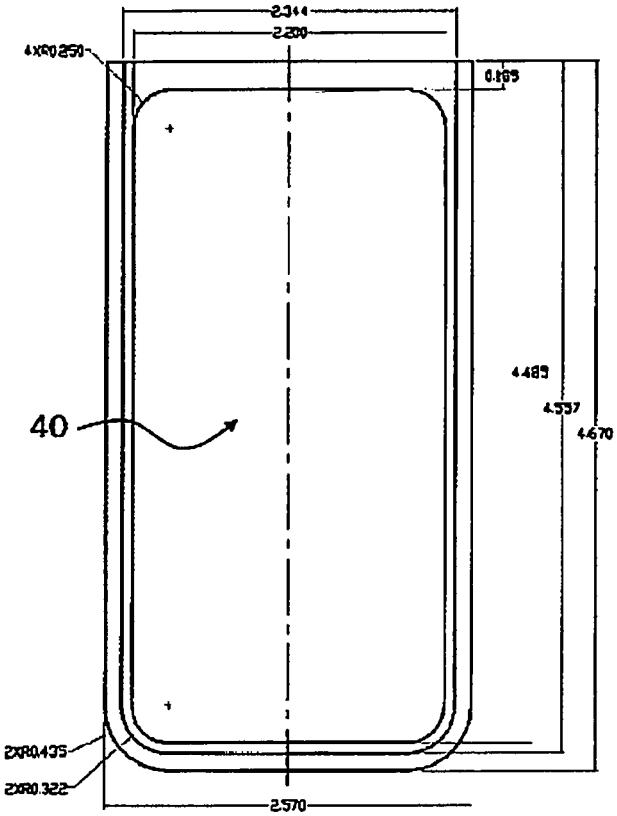
FIG. 6*b* illustrates a top planer view of the major/primary compartment of the case shown in FIG. 1.
Figure 6C:
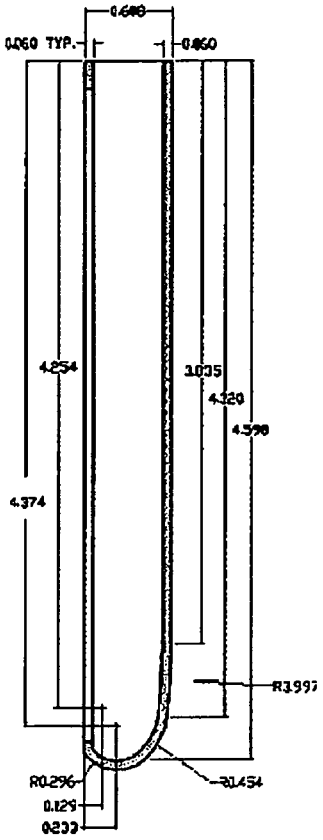
FIG. 6*c* illustrates a side view of the major/primary compartment of the case shown in FIG. 1.
Figure 7:
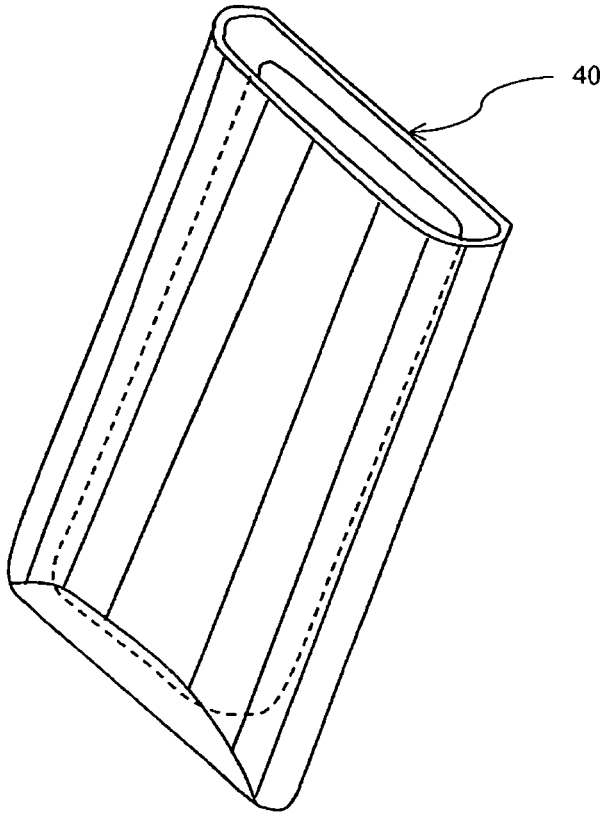
FIG. 7 illustrates a top view of the major/primary compartment of the case shown in FIG. 1.

FIG. 4*a*-4*c* illustrate views of the top portion 13 of the device which is constructed to provide slidablity of the compartments and/or rotation and pivoting of the covers to access the compartments. Particularly, FIG. 4*a* illustrates a side-sectional view of the top portion of the case shown in FIG. 1; FIG. 4*b* illustrates a top-sectional view of the top portion of the case shown in FIG. 1; and FIG. 4*c* illustrates a top-sectional view of the top portion of the case shown in FIG. 1. FIG. 5*a*-5*c* illustrate view of the cell compartment. FIGS. 6*a*-6*c* illustrate a sectional view of the top of the major/primary compartment of the case. FIG. 7 illustrates a top view of the major/primary compartment of the case shown in FIGS. 6*a*-6*c*.

Figure 8A:
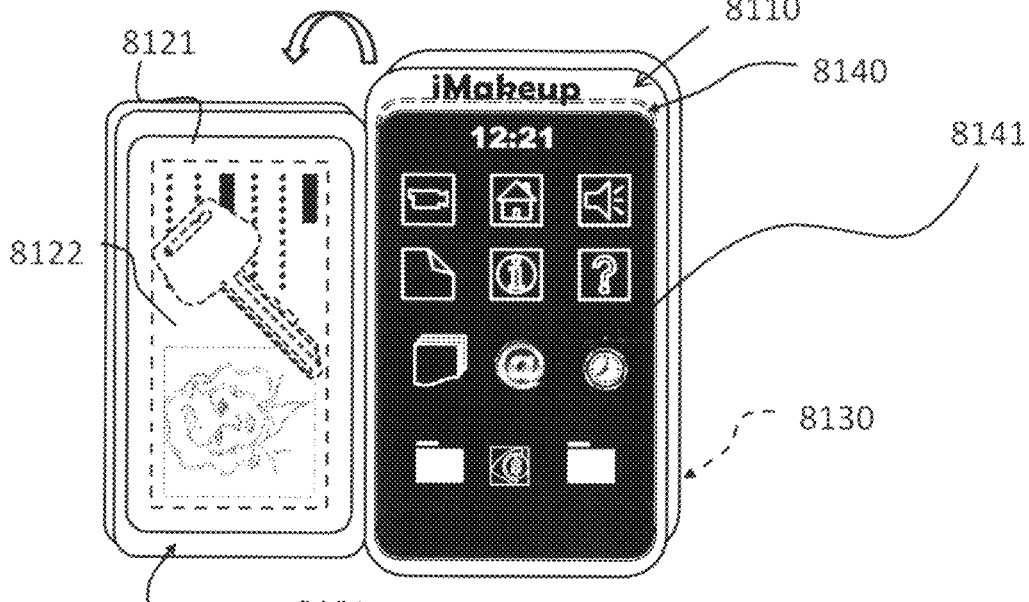
FIG. 8*a* illustrates an embodiment of the compartmentalized protective case wherein a second cell compartment is provided for housing an identification, currency and/or a key.
Figure 8B:
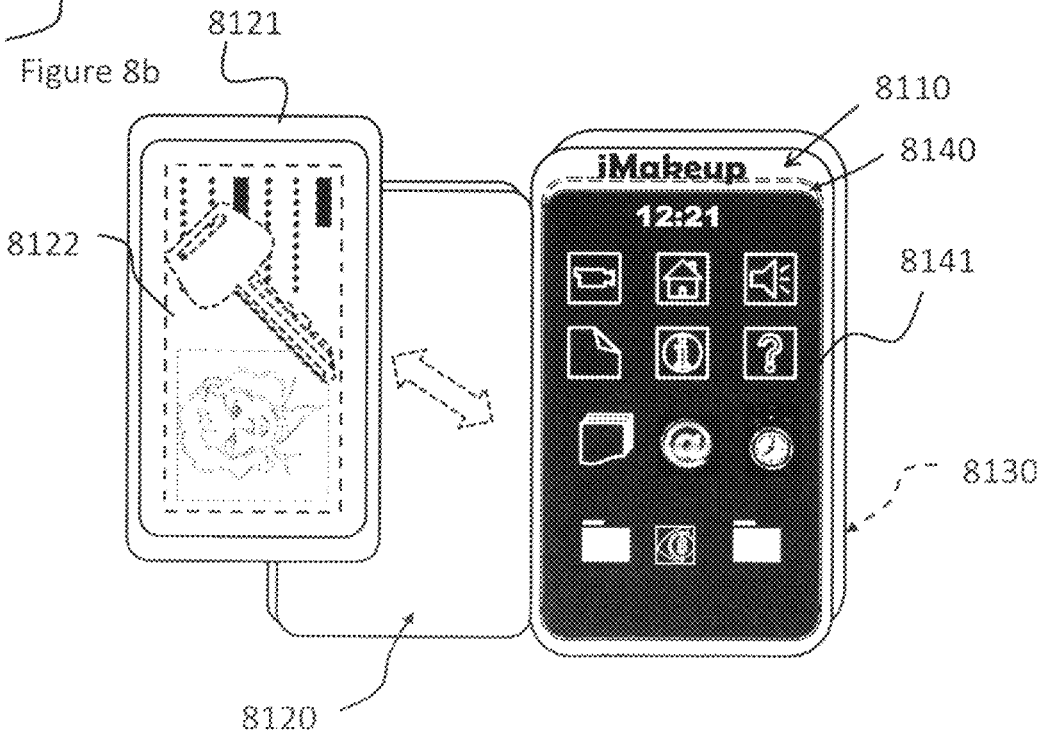
FIG. 8*b* illustrates removable attachment of the second cell compartment.
Figure 8C:
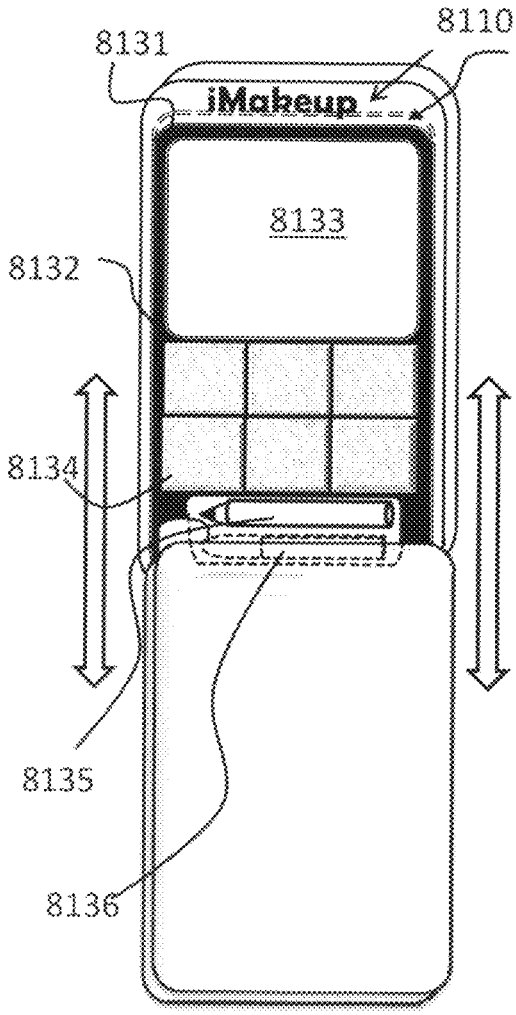
FIG. 8*c* illustrates the cell compartment in an open condition.
Figure 8D:
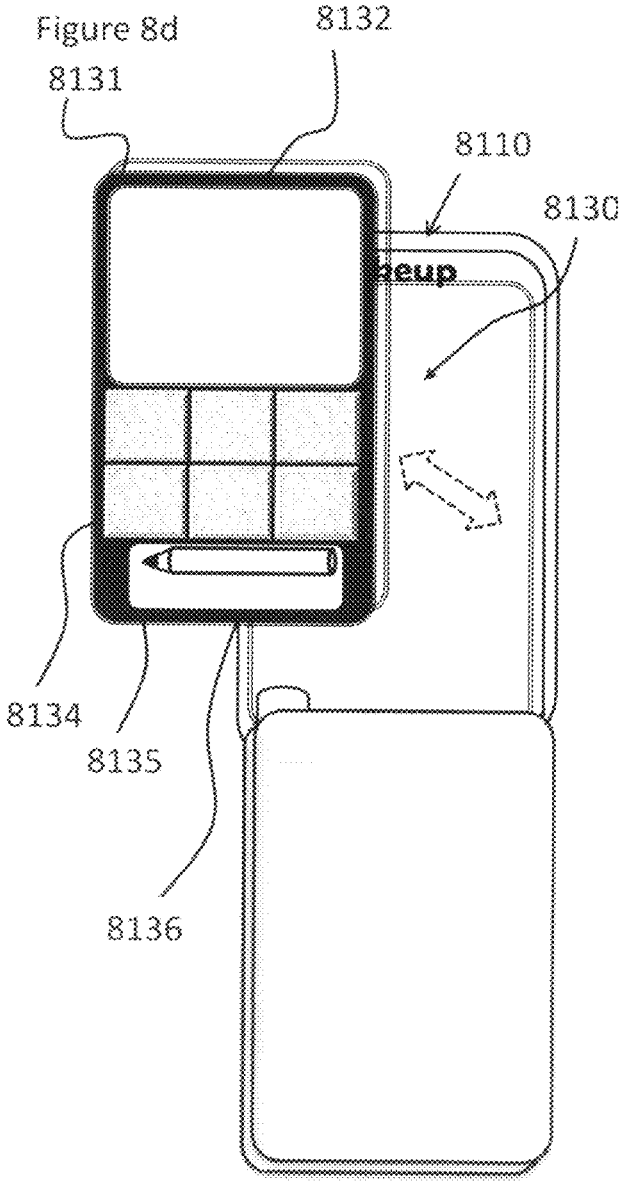
FIG. 8*d* illustrates the cell compartment showing insertion of a makeup kit.
Figure 9A:
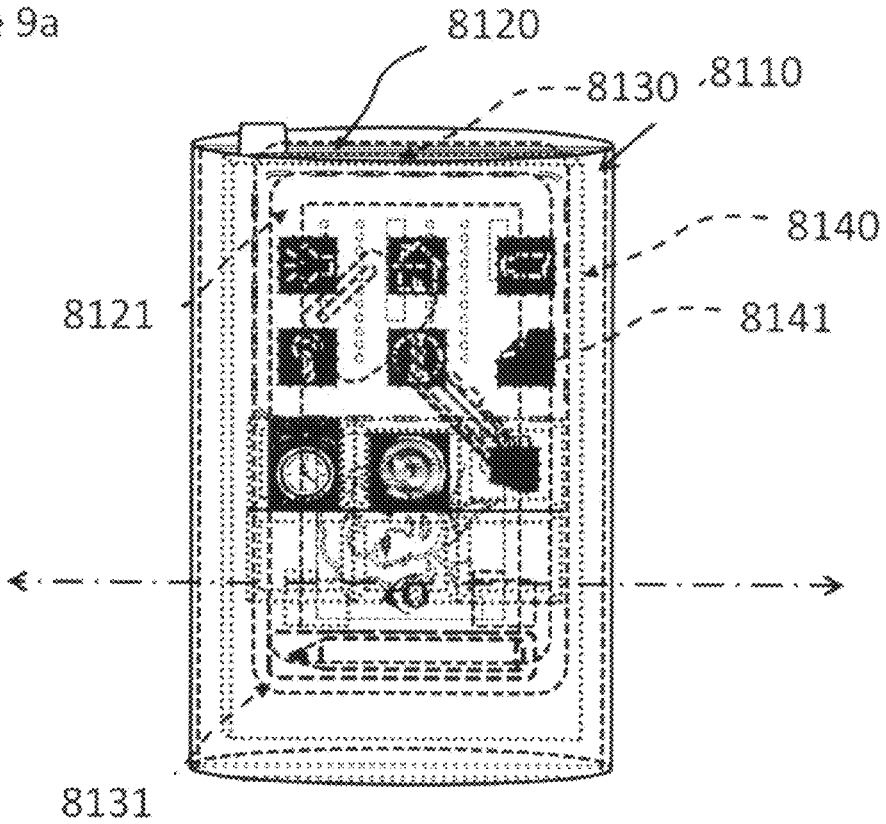
FIG. 9*a* illustrates a schematic view of an embodiment of the compartmentalized protective case.
Figure 9B:
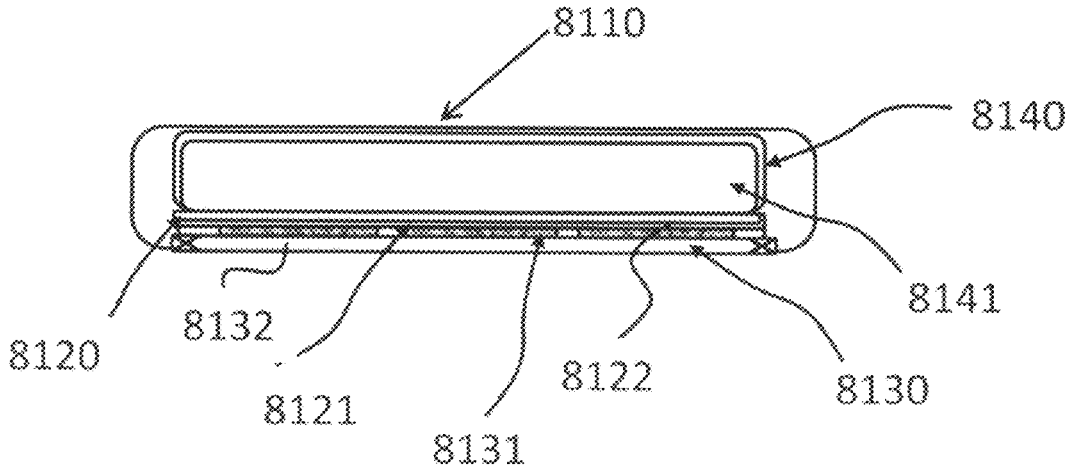
FIG. 9*b* illustrates a cross-sectional view taken along line x-x.

FIGS. 8*a*-8*d* illustrate the compartmentalized protective case having a second cell compartment, and with the case in the open configurations (FIGS. 8*a* and 8*b* show a second cell compartment and the major compartment while FIGS. 8*c* and 8*d* show the cell compartment); and FIGS. 9*a* and 9*b* illustrate the compartmentalized protective case schematically illustrated in FIGS. 8*a*-8*d*, however shown in the closed condition, depicting a top plane view and a cross-sectional view taken along line x-x. Compartmentalized protective case 8110 comprises a major compartment 8140 appointed for receiving and housing a handheld electronic device, herein shown as a smart phone 8141. As discussed hereinabove, the handheld electronic device can be a plethora of different heretofore known or otherwise later invented handheld electronic devices. Compartmentalized protective case 8110 further comprises at least one cell compartment appointed for receiving and housing at least one personal item, herein case 8110 includes two cell compartments hereinafter referred to as a first cell compartment 8120 and a second cell compartment 8130 preferably piggybacked upon one another, both of which are shown in the open configuration in FIGS. 8*a*-8*d* and in the closed configuration in FIGS. 9*a* and 9*b*.

Cell compartments 8120, 8130 are enclosed with either a hinge or sliding cover. Cell compartments 8120, 8130 form containments for receiving replaceable cells 8121, 8131 held in place with adhesives, magnets, mechanical or adhesive means (such as hook and loop fasteners) so that the cells 8121, 8131 enclosed within the cell compartments 8120, 8130 can be replaced and visa via the personal care products integrated within the cells are replaceable. Cell 8131 includes individually replaceable components/personal care items. Herein, the replaceable cell 8131 comprises a mini-makeup kit 8132. The mini-makeup kit 8132 includes a mirror 8133, eye makeup 8134, eyeliner 8135 and an applicator 8136, for example. These personal care products are replaceable components within cell 8131. The mirror 8133, applicators 8136, each individual lip gloss color/eye makeup 8124, etc., are each individual personal care product cells that can be replaced in different configurations. This way each person can setup their own personalized personal care kit to carry exactly what they want, when they want. All replaceable parts (parts 8133-8135) can be popped in and out of the compartment 8130. This would include any part used as a tray to secure the personal care products. Replaceable cells 8133-8135 may include a plethora of personal items including a plethora of different health care items, oral hygienic items, beauty supplies such as eye makeup, lip gloss, powder, concealer, foundation, blush, and/or combinations thereof so that a user can refresh her look throughout the day or evening.

Preferably second cell compartment 8120 is appointed to receive a replaceable cell 8121 which comprises a pouch 8122 that is held in place within the first cell compartment 8120 with a magnet, hook and loop fasteners (such as that sold under the trade name VELCRO) or adhesive. Pouch 8122 is adapted to receive and house personal items such as identification cards (ID), credit cards, bank cards, currency, keys, business cards, etc. As shown in FIG. 8*b*, replaceable cell 8121 comprising pouch 8122 is received within first cell compartment 8120.

FIGS. 9*a* and 9*b* show a top plane view and a cross-sectional view taken along line x-x. Compartmentalized protective case 8110 comprises a major compartment 8140 appointed for receiving and housing handheld electronic device, smart phone 8141. Compartmentalized protective case 8110 further comprises two cell compartments 8120 and 8130, both of which are shown in the closed configuration herein. Cell compartments 8120, 8130 are enclosed with either a hinge or sliding cover. Cell compartments 8120, 8130 form containments for receiving replaceable cells 8121, 8131 that can be replaced and/or include replaceable cells or compartments therein for personal care products. Second cell compartment 8120 is appointed to receive a replaceable cell 8121 which comprises a pouch 8122 adapted to receive and house personal items such as identification cards (ID), credit cards, bank cards, currency, keys, business cards, etc. First cell compartment 8130 is appointed to receive replaceable cell 8131 which comprises a mini-makeup kit 8132. Second cell compartment 8120 is preferably located on the top side of the case, just under the first cell compartment 8130 storing the personal care items. Second cell compartment 8120 is preferably hinged and opens to reveal the face of the electronic device 8141. Both the wallet portion (second cell compartment 8120), and the personal care item storage compartments (first cell compartment 8130) are contained in the top side of the case 8110. (This will allow a variety of back plate styles to be sold to the consumer).

Figure 10A:
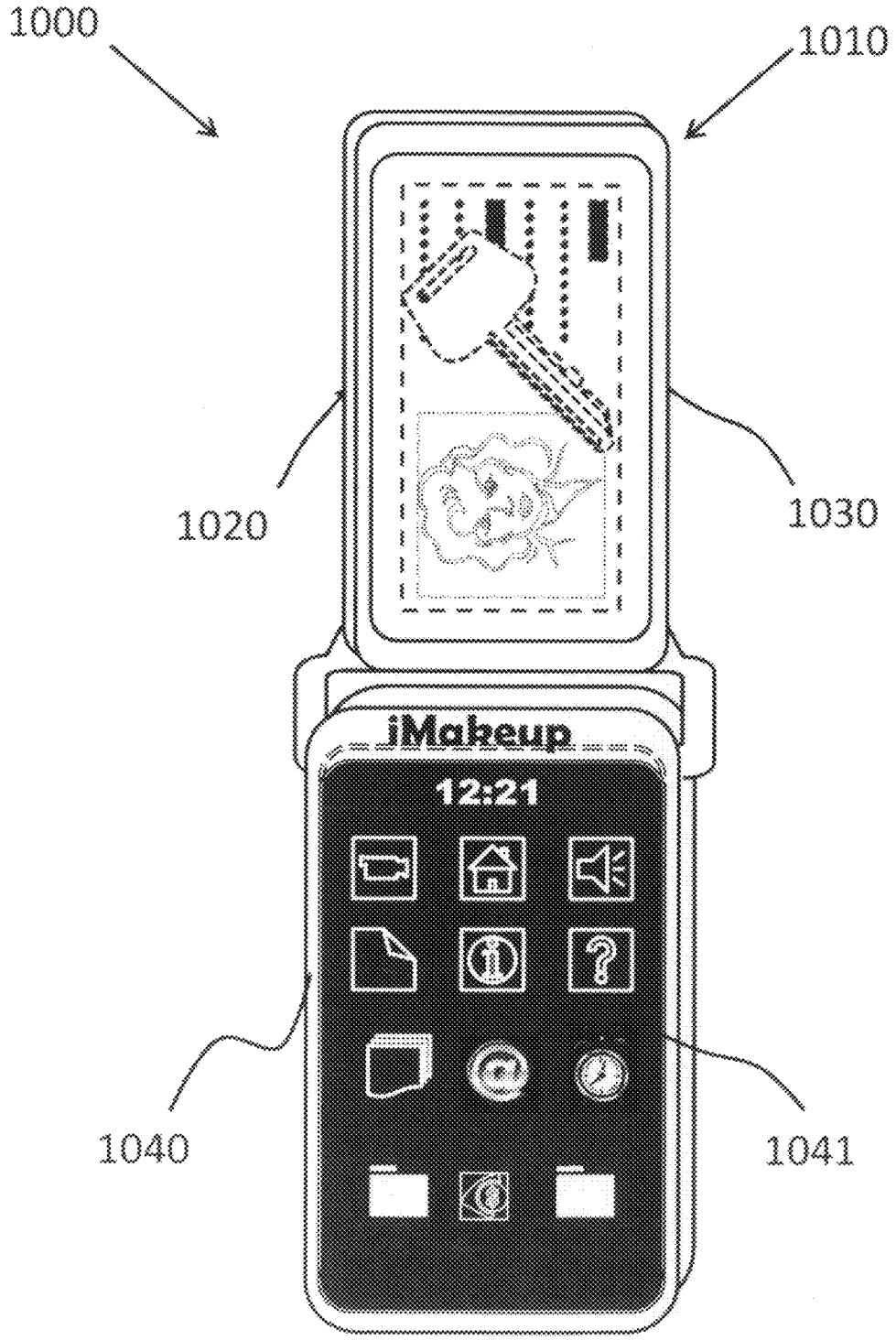
FIG. 10*a* illustrates a schematic view of an embodiment of the compartmentalized protective case.
Figure 10B:
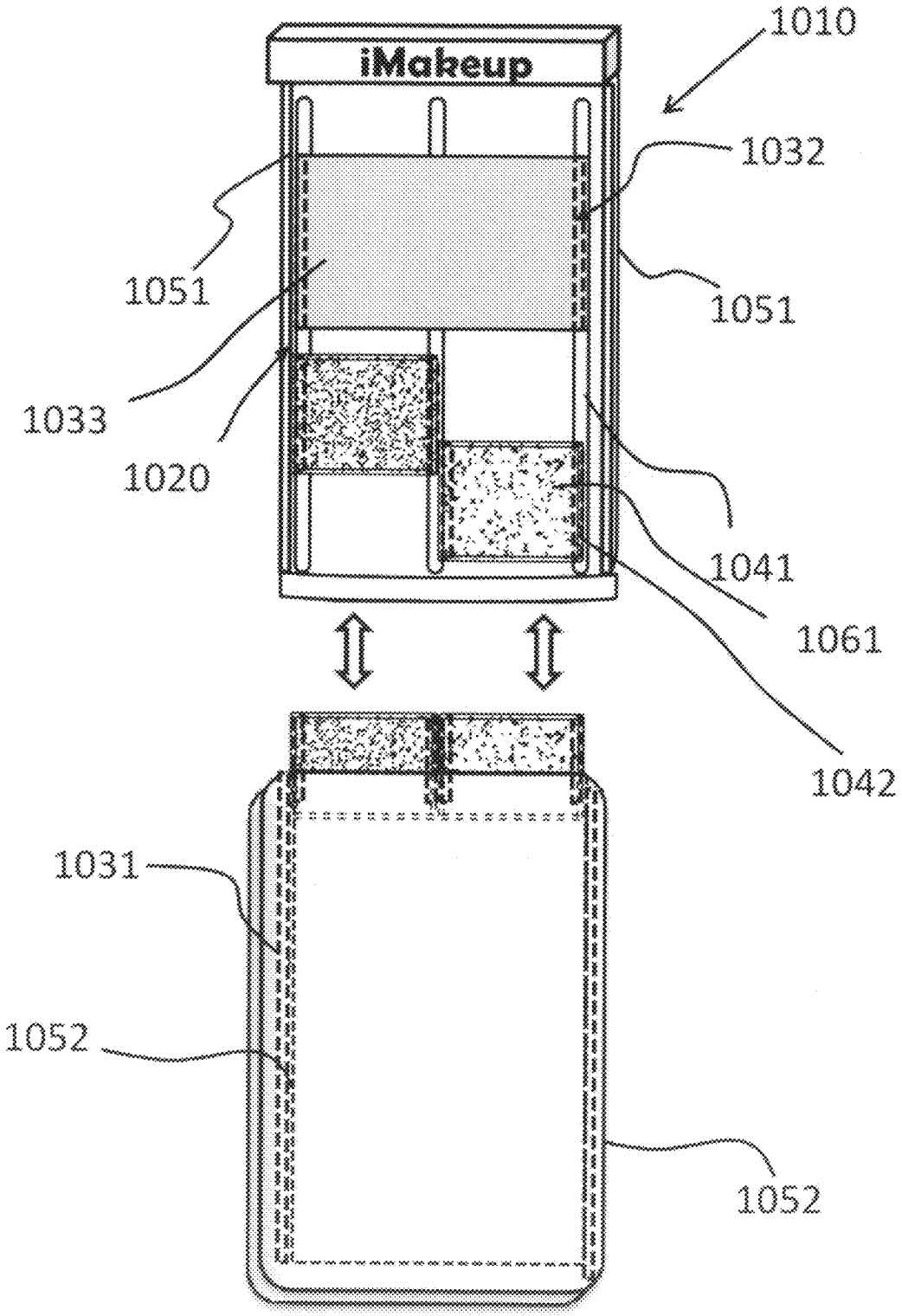
FIG. 10*b* illustrates a view of an optional second cell compartment in the open configuration.

FIGS. 10*a* and 10*b* illustrate another embodiment of the compartmentalized protective case, shown generally at 1000. Compartmentalized protective case 1010 comprises a major compartment 1040 appointed for receiving and housing a handheld electronic device, herein shown as a smart phone 1041. Compartmentalized protective case 1010 further comprises at least one cell compartment appointed for receiving and housing at least one personal item, herein case 1010 includes two cell compartments hereinafter referred to as a second cell compartment 1020 and a first cell compartment 1030 preferably piggybacked upon one another, both of which are shown in the open configuration in FIGS. 10*a* and 10*b*, respectively. Cell 1020 is herein shown flipped open via pivoting motion from the major compartment 1040, and includes a pouch for housing an ID or the like. Cell 1030 includes a slidable cell cover 1031 that is slidabley mounted on cell 1020, and is best illustrated in FIG. 10*b*.

Preferably, cell 1030 comprises grooves 1051 for mating with rails 1052 integrated within side edges of the rear of cell compartment 1020 so that cell cover 1031 slides open and shut. Secondary rails 1041 are integrated within cell compartment 1030 appointed for mating with secondary grooves 1042 correspondingly integrated on the backside of individual replaceable cells 1061 including cosmetics integrated therein, forming a mini-makeup kit 1032. In this manner, individual replaceable cells 1061 can be readily interchanged and a user can select her unique color palette or cosmetic needs. Further, a mirror 1033 is slidably mounted on the secondary rails 1041. These individual replaceable cells 1061 are replaceable components and may include lip gloss color/eye makeup, powder, concealer, foundation, blush, and/or combinations thereof so that a user can refresh her look throughout the day or evening.

Figure 11A:
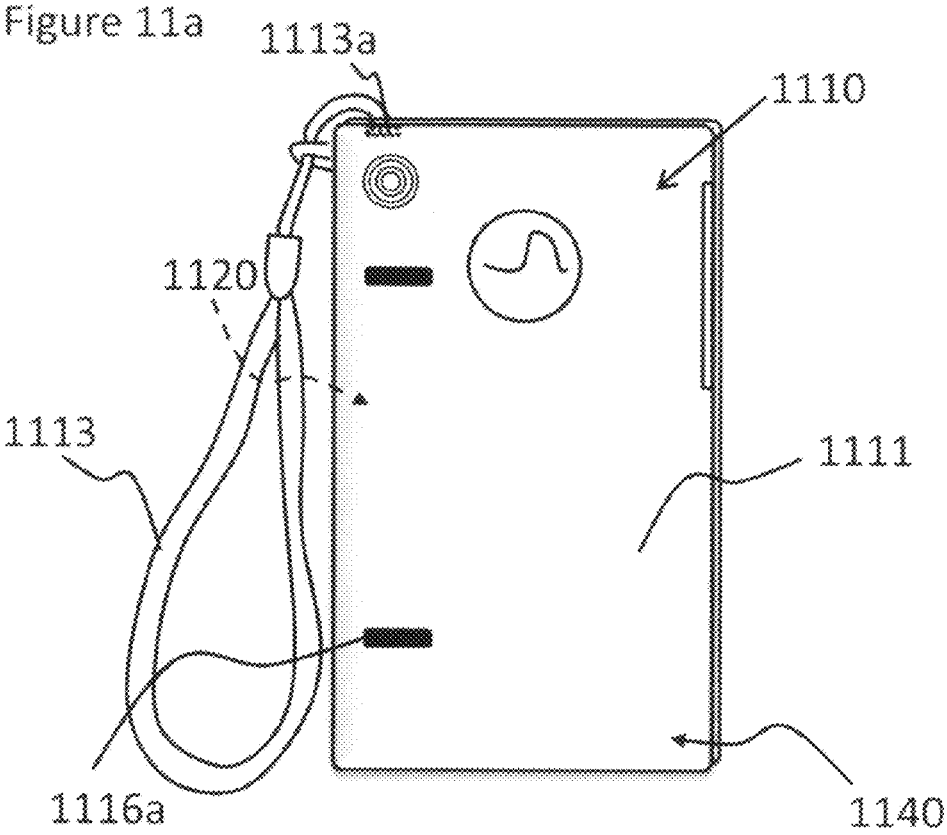
FIG. 11*a* illustrates a front view of an embodiment of the compartmentalized protective case appointed with a hand strap/wristlet attachment.
Figure 11B:
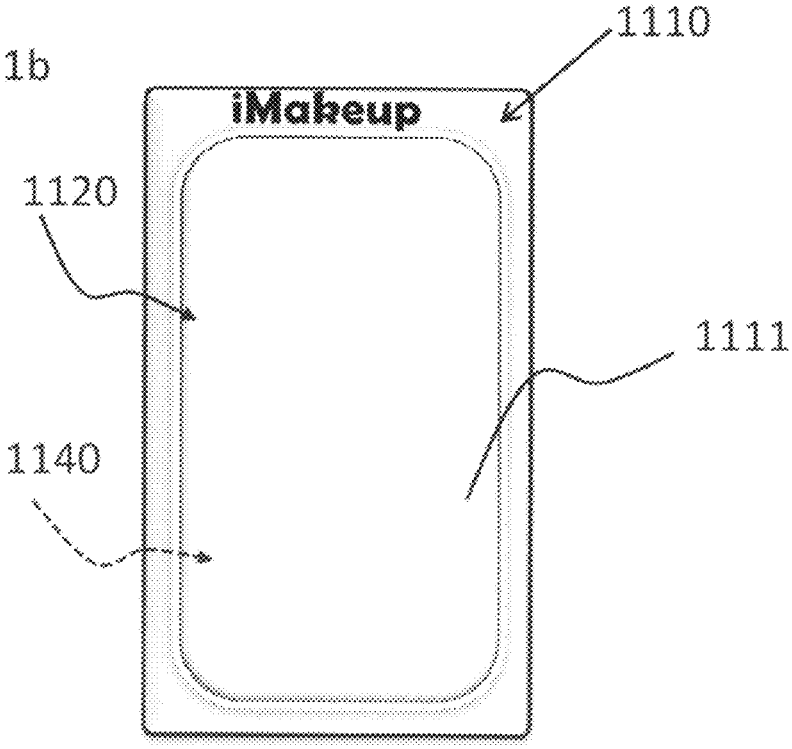
FIG. 11*b* illustrates a back view.
Figure 12A:
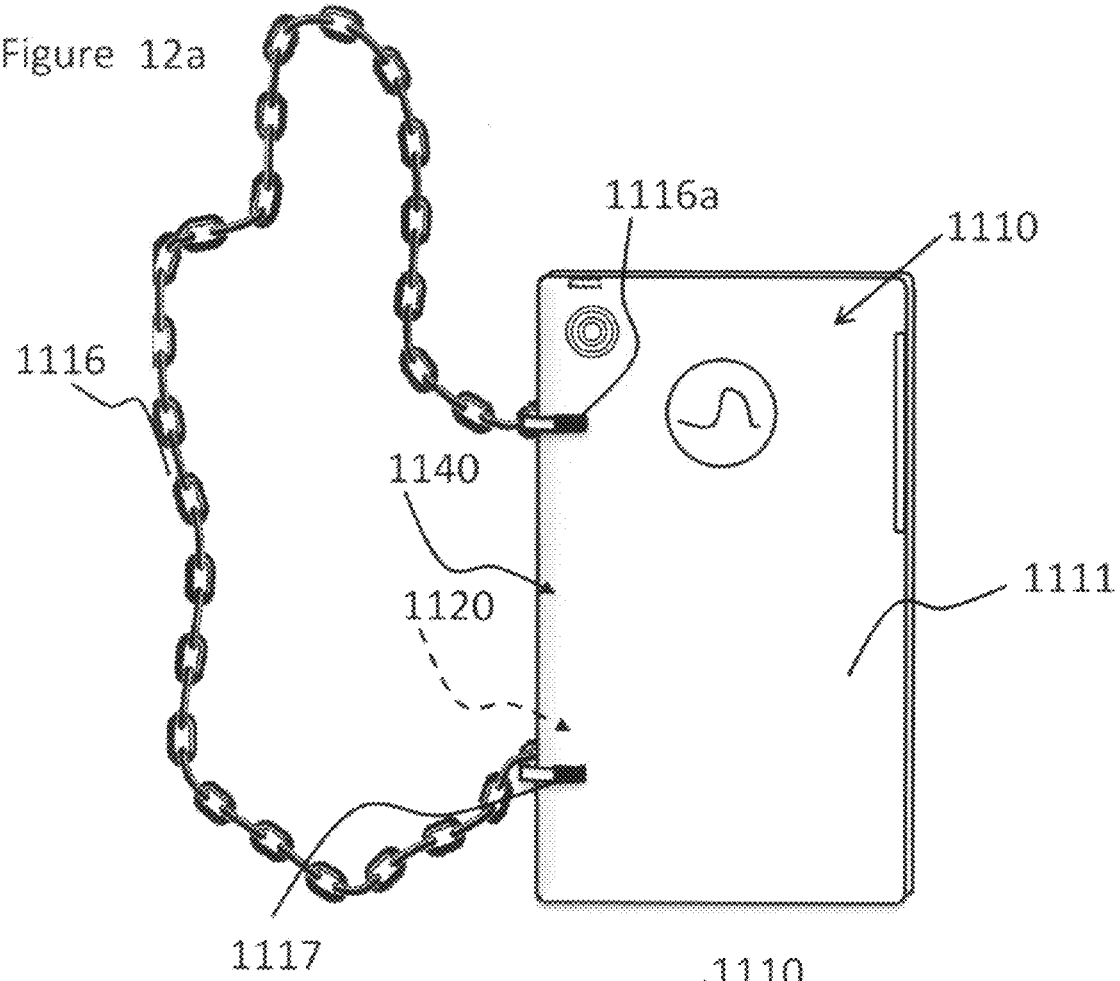
FIG. 12*a* illustrates a front view of an embodiment of the compartmentalized protective case appointed with a strap attachment.
Figure 12B:
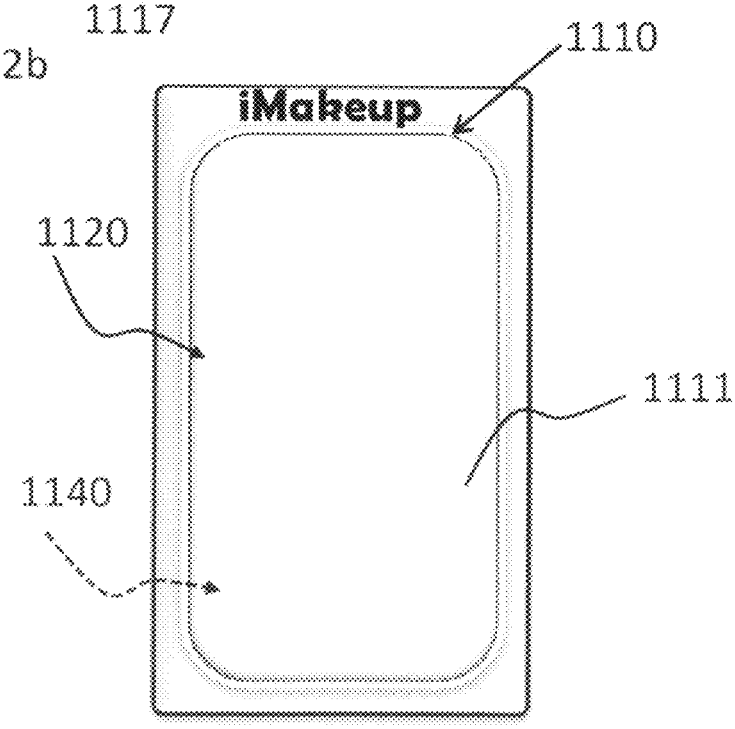
FIG. 12*b* illustrates a back view.

FIGS. 11*a* and 11*b* illustrate overviews of an embodiment of the compartmentalized protective case with a hand strap/wristlet attachment; FIGS. 12*a* and 12*b* illustrate overviews of the compartmentalized protective case with a larger strap/clutch type of strap attachment. In referring to FIGS. 11*a* and 11*b* and FIGS. 12*a* and 12*b*, the compartmentalized protective case 1110 includes a front side 1111 and a back side 1112, a primary compartment 1140 and a cell compartment 1120. The case 1110 as shown in FIGS. 11*a*, 11*b*, 12*a* and 12*b*, is in the closed condition. The case 1110 in FIGS. 11*a* and 11*b* includes an opening 1113*a* appointed to receive a wristlet attachment 1113 for portability. The case 1110 in FIGS. 12*a* and 12*b* includes at least two parallel openings 1116*a* appointed to receive a strap or chain attachment 1116 for portability via optional clutch strap attachment means 1117 integrated within the front side 1111 of case 1110.

In a first embodiment, the compartmentalized protective case comprises: (i) a major compartment appointed for receiving and housing a handheld electronic device; and (ii) at least one cell compartment appointed for receiving and housing at least one personal item. The personal care item preferably comprises a cosmetic panel. Preferably, the cosmetic panel comprises at least one individual interchangeable cosmetic component, such as eye shadow, lipstick, pressed powder, etc. The individual components may be popped out of the cell compartment and replaced with another component.

In a second embodiment, the compartmentalized protective case comprises: (i) a major compartment appointed for receiving and housing a handheld electronic device; (ii) at least one cell compartment appointed for receiving and housing at least one cosmetic panel; and (iii) at least one cell compartment appointed for receiving and housing an identification card or ID. Preferably, the ID cell compartment is a removable pouch, sleek in nature, and appointed to be released from the case. Alternatively, the ID cell compartment is a sleek shallow segment which either pivots from the case, or alternatively slides from the case.

Key features of the compartmentalized protective case for a portable electronic device and method include:

1. a protective case for portable electronic devices, such as cell phones, smart phones, iPhones®, iPods®, Blackberry® devices, media players, etc;
2. providing compartments that contain personal care products integrated therein, and/or applicators;
3. the personal care products are contained in replaceable cells;
4. the replaceable cells can be held in place with adhesives, clips, magnets, mechanically, or by materials that create adhesion;
5. compartments are enclosed with either a hinged or sliding cover;
6. one or more compartments can hold a mirror or reflective material;
7. a replaceable pouch or restraining system may be integrated within the case appointed for use a wallet or storage for an ID, credit cards, money, a key, etc.;
8. the replaceable pouch may be held in place with adhesives or hook and loop fasteners;
9. an opening on the body of the case may be provided to attach a wristlet;
10. parallel openings on the body of the case may be provided to attach a strap or chain.

The compartmentalized protective case and method of use disclosed herein can be modified in numerous ways without departing from the scope of the invention. For example, different materials or attachment fasteners and a variety of personal products may be used. These and other modifications are intended to fall within the scope of the invention, as defined by the subjoined claims.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A compartmentalized protective case for a portable electronic device, comprising:

a. a major compartment appointed to receive and house a portable electronic device, said major compartment forming a single uninterrupted compartment, said major compartment defining two major sides of the protective case including an open major first side of the protective case, thereby enabling said portable electronic device to be viewed from an exterior of the compartmentalized protective case when housed within the major compartment, and a generally closed major second side of the protective case opposing the open major first side of the protective case, the open major first side of the protective case defined at least in part by first and second opposing sidewalls, wherein each of the first and second sidewalls defines at least a portion configured to overlie the electronic device when housed within the major compartment so as to prevent the device from falling out of the major compartment through the open major first side of the protective case;

b. at least one cell compartment located in and substantially forming a side of said case housing personal items, wherein said major compartment and said at least one cell compartment are arranged parallel to and piggybacked upon one another;

c. said major compartment and said at least one cell compartment being connected to one another by way of a hinge;

d. said hinge operates to open and close said major compartment and said at least one cell compartment, thereby allowing access to said major compartment and said at least one cell compartment;

e. said personal care items comprising a mini-makeup kit that includes internal attachment means for securing a plurality of makeup cells having mating cell attachment means, wherein said mini-makeup kit includes internal attachment means and said makeup cells include cell attachment means in mating communication for securing said plurality of makeup cells, wherein said makeup cells are replaceable cells removable from said mini-makeup kit for unique selection and interchangeability of said makeup cells; and f. a mirror or reflective material.

2. A compartmentalized protective case as recited in claim 1, wherein said personal care items comprise at least one medication.

3. A compartmentalized protective case as recited by claim 1, wherein said personal care items comprise at least one cosmetic.

4. A compartmentalized protective case as recited by claim 1, wherein said personal care items are selected from a group consisting of identification, keys, money, and business cards.

5. A compartmentalized protective case as recited by claim 1 comprising at least one applicator for delivery of said personal care item.

6. A compartmentalized protective case as recited by claim 1 comprising a second cell compartment.

7. A compartmentalized protective case as recited by claim 6, wherein said second cell compartment is a pouch for receiving of personal items.

8. A compartmentalized protective case as recited by claim 6, wherein said second cell compartment includes a clip.

9. A compartmentalized protective case as recited by claim 6, wherein said second cell compartment includes a restraining system.

10. A compartmentalized protective case as recited by claim 1, wherein said major compartment is enclosed with a hinged cover.

11. A compartmentalized protective case as recited by claim 1, wherein said at least one cell compartment is enclosed with a hinged cover.

12. A compartmentalized protective case as recited by claim 1, wherein said major compartment is enclosed with a sliding cover.

13. A compartmentalized protective case as recited by claim 1, wherein said at least one cell compartment is enclosed with a sliding cover.

14. A compartmentalized protective case as recited by claim 1 comprising an opening appointed to receive a wristlet attachment.

15. A compartmentalized protective case as recited by claim 1 comprising at least two parallel openings appointed to receive a strap or chain attachment.

16. A compartmentalized protective case for a portable electronic device, comprising:

a. a major compartment appointed to receive and house a portable electronic device, said major compartment forming a single uninterrupted compartment, said major compartment defining two major sides of the protective case including an open major first side of the protective case, thereby enabling said portable electronic device to be viewed from an exterior of the compartmentalized protective case when housed within the major compartment, and a generally closed major second side of the protective case opposing the open major first side of the protective case, the open major first side of the protective case defined at least in part by first and second opposing sidewalls, wherein each of the first and second sidewalls defines at least a portion configured to overlie the electronic device when housed within the major compartment so as to prevent the device from falling out of the major compartment through the open major first side of the protective case;

b. at least one cell compartment located in and substantially forming a side of said case housing personal items, wherein said major compartment and said at least one cell compartment are arranged parallel to and piggybacked upon one another;

c. said major compartment and said at least one cell compartment being connected to one another by way of a hinge;

d. said hinge operates to open and close said major compartment and said at least one cell compartment, thereby allowing direct access to said major compartment and said at least one cell compartment;

e. said major compartment consisting essentially of a durable material forming a shell so as to provide protection to said portable electronic device housed therein;

f. said personal care items comprising a mini-makeup kit that includes internal attachment means for securing a plurality of makeup cells having mating cell attachment means, wherein said mini-makeup kit includes internal attachment means and said makeup cells include cell attachment means in mating communication for securing said plurality of makeup cells, wherein said makeup cells are replaceable cells removable from said mini-makeup kit for unique selection and interchangeability of said makeup cells; and g. a mirror or reflective material.

* * * * *